US006823238B1

(12) United States Patent
Hensley et al.

(10) Patent No.: US 6,823,238 B1
(45) **Date of Patent: *Nov. 23, 2004**

(54) SELECTIVE APPARATUS AND METHOD FOR REMOVING AN UNDESIRABLE CUT FROM DRILLING FLUID

(75) Inventors: Gary L. Hensley, Kingwood, TX (US); Lee Hilpert, Livingston, TX (US)

(73) Assignee: Hutchison Hayes L.P., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/579,702

(22) Filed: May 26, 2000

Related U.S. Application Data

(63) Continuation-in-part of application No. 09/060,046, filed on Apr. 14, 1998, now Pat. No. 6,073,709.

(51) Int. Cl.[7] ..... G01N 31/00

(52) U.S. Cl. ..... 700/273; 210/113; 210/623; 210/713; 210/767; 210/770; 210/781; 210/805; 494/4

(58) Field of Search ..... 700/273, 271; 210/113, 300, 602, 623, 702, 713, 767, 768, 769, 770, 781, 729, 800, 805, 607, 712, 787; 175/66; 494/4, 5

(56) References Cited

U.S. PATENT DOCUMENTS

| | | | | |
|---|---|---|---|---|
| 2,870,990 A | | 12/1959 | Bergey | 175/66 |
| 3,070,291 A | | 12/1962 | Bergey | 494/1 |
| 3,737,037 A | | 6/1973 | Bone, III | 175/66 |
| 3,964,557 A | | 6/1976 | Juvkam-Wold | 175/66 |
| 4,413,511 A | * | 11/1983 | Godbey | 73/152.42 |
| 4,482,459 A | | 11/1984 | Shiver | 210/639 |
| 4,571,296 A | | 2/1986 | Lott | 209/17 |
| 4,670,139 A | | 6/1987 | Spruiell et al. | 210/167 |
| 5,107,874 A | | 4/1992 | Flanigan et al. | 134/60 |
| 5,129,469 A | | 7/1992 | Jackson | 175/66 |
| 5,190,645 A | | 3/1993 | Burgess | 210/144 |
| 5,344,570 A | | 9/1994 | McLachlan et al. | 210/709 |
| 5,454,957 A | | 10/1995 | Roff | 210/768 |
| 5,494,584 A | | 2/1996 | McLachlan et al. | 210/739 |
| 5,857,955 A | | 1/1999 | Phillips et al. | 494/5 |
| 5,882,524 A | | 3/1999 | Storey et al. | 210/712 |
| 6,036,870 A | * | 3/2000 | Briant et al. | 210/781 |
| 6,143,183 A | * | 11/2000 | Wardwell et al. | 210/739 |

* cited by examiner

*Primary Examiner*—Albert W. Paladini
*Assistant Examiner*—Chad Rapp
(74) *Attorney, Agent, or Firm*—Law Office of Tim Cook P.C.

(57) ABSTRACT

A method and apparatus selective remove undesirable low gravity components from the return stream of drilling mud. The apparatus receives mud returned from the well borehole and transfers the mud to a tank. Mud from the tank is treated in a separation system including a plurality of mass flow sensor to monitor operation of the system.

17 Claims, 2 Drawing Sheets

SELECTIVE APPARATUS AND METHOD FOR REMOVING AN UNDESIRABLE CUT FROM DRILLING FLUID

This is a Continuation-in-Part of application Ser. No. 09/060,046 filed Apr. 14, 1998, now U.S. Pat. No. 6,073,709.

BACKGROUND OF THE INVENTION (1) Field of the Invention

The present invention relates generally to fluid clarification systems and, more particularly, to a system and method of selectively separating undesirable solids from a fluid, particularly drilling mud, while retaining certain desirable solids in the fluid so that the fluid can be subsequently used. Further, the present invention relates to a fluid clarification system which is controlled for maximum efficiency of the removal of undesirable solids from the fluid.

(2) Description of Related Art

The present invention provides a fluid clarification system which may be used with a drilling rig. When an oil well is drilled, it is necessary to drill the well with drilling fluid, commonly referred to in the art as drilling mud. The drilling mud is provided to lubricate and cool the drill bit and to carry away cuttings as the mud flows upwardly in the annular flow space around the drill string. The drilling mud is pumped down the drill string to pick up the cuttings and other debris. Commonly, the drilling mud is water but it is sometimes made with an oil or oil-based carrier.

Generally, various heavy metal or other minerals are added to drilling mud to give it a selected weight and viscosity. The viscosity is obtained from clay or clay products. The drilling mud becomes slick to the touch so that it provides a lubricating benefit.

When drilling into a high pressure formation, safety is enhanced by incorporating a weight component, such as barium sulfate, barite, or hematite, for example, to the drilling mud. Water has a weight of about 8.4 pounds per gallon. The weight of the drilling mud can be increased to as much as 17 or 18 pounds per gallon by adding the weight materials. Occasionally, higher weights are achieved by addition of these or other weight materials. The weight materials may have a relative density of around 4.0 compared to water which has a density of 1.0.

While circulating through the well, drilling mud picks up particles of the earth formations cut by the drill bit. It is relatively easy to clean the drilling mud if the cuttings are primarily heavy rock. Also, large particle cuttings are easily removed from the mud by passing the drilling mud through a set of screens. In general, as mud is returned to the surface, it typically flows into a mud pit and then is pumped out of the mud pit by a mud pump. While flowing from the well to the mud pit and then back to the mud pump, the mud typically is treated by a number of devices to restore the mud to its original condition, such devices including shale shakers, desanders, degassers, and other cleaning devices.

At times, the mud will simply be permitted to sit in an open pit. This enables the heavy particles in the mud to settle to the bottom. Gas bubbles also are removed so that entrained gas bubbles do not create a risk of explosion by accumulating odorless natural gas around the mud pits. Drilling mud with such entrained gas is also too light for almost all applications.

In many ways, separation techniques applied to drilling mud run into problems because of the separation of the desirable added components along with the undesirable components retrieved from the well. As previously described, drilling mud returning from down hole comprises a fluid such as water or a synthetic oil, high gravity materials added to the drilling mud, and low gravity solids (i.e., cuttings) from the drilling operation. Sometimes, depending on the nature of the formation penetrated, the mud will be commingled with cuttings from sand and shale formations (a specific gravity of about 2.6). Sand cuttings are relatively easy to remove. Shale cuttings, having a smaller particle size, are more difficult to sort or separate and cannot be wholly removed by sieves or screens. Moreover, cuttings from clay formations are dissolved into the solution of the drilling mud so that no amount of mechanical screening or filtration can remove them. Operators typically maintain low gravity solids in the drilling mud at 5–6% volume percent of the drilling mud. If undesirable components cannot be removed from the drilling mud, then either the drilling mud must be replaced or diluted with more drilling fluid. Either solution to the problem is quite expensive.

In drilling a well, and especially a deep well, the problems just described are minor at shallow depth and become more and more significant with depth. Typically, the first several hundred feet of drilling will be accomplished in just a day or so and the borehole is drilled rather rapidly. The problem arises at greater depths where the drill bit penetrates several formations of shale. The clay that is in the shale will dissolve, thereby changing the physical characteristics and performance of the drilling mud. Mud will no longer exhibit the integrity necessary for continued reuse. As the drilling mud is adulterated with added well bore materials, it ultimately is necessary to dispose of the entire batch of mud. At that point, the well is quite deep and the amount of mud required for replenishment can be as much as 2000 barrels of fluid. This is expensive with a water based mud and even more expensive with an oil based mud. Some drilling fluids cost as much as $300 per barrel in 1998 prices. It is not uncommon to have as much as $1,000,000 worth of drilling fluid solvents mixed into the drilling fluid and in circulation in a well. It is therefore desirable to extend the useful life of drilling mud as long as possible by removing cuttings and dissolved undesirable components from the drilling mud while retaining the high gravity additives in the mud.

Thus, there is a direct economic benefit in removing as much of the undesirable solids from the drilling mud while retaining the additives in the mud. The natural inclination of operators of clarification systems in the field is to maximize the flow rate of drilling mud through the system. However, running the system at maximum flow rate does not necessarily remove the greatest amount of the cuttings. So, there remains a need for a system with installed controls to operate the system for the maximum efficiency in the removal of the cuttings from the drilling mud. Further, there remains a need for a system which demonstrates the cost savings to the operator if the system is operated at such a maximum efficiency operating point.

SUMMARY OF THE INVENTION

The present invention provides a method and apparatus for selective removal of such undesirable low gravity components from the return stream of the drilling mud for maximum efficiency in removing these undesirable components. The apparatus is preferably adapted to be mounted on a skid and installed at a drilling rig. It is preferably skid mounted for ease of transport to and from a work site.

The apparatus of the present invention receives mud returned from the well borehole. The mud is transferred by a pump to a tank and then is delivered from the tank through a first centrifuge. The first centrifuge removes the heavier components and provides a "solids" discharge and a liquid discharge in the manner well known in the art. The solids discharge from the first centrifuge comprises the heavier particles from the drilling mud which are delivered from the first centrifuge in a wet slurry of about 40% solids and 60% fluid. While some drying does occur, the system is operated so that significant and substantial recovery of all the expensive weight material is removed from the mud. In situations where the fluid is an oil based mud, the oil can be recovered also.

The fluid discharge from the first centrifuge, with high gravity components removed but with the undesirable low gravity components still entrained in the mud, is then directed to a second centrifuge. Here, the low gravity components are removed and the second centrifuge provides a "solids" discharge and a fluid discharge. The high gravity components, previously separated by the first centrifuge, are then added back into the fluids discharged from the second centrifuge.

The present invention further provides a system of sensors coupled to a control unit to measure solids content at various points in the system. The sensors and associated control unit determine the amount of solids being removed by the mud processing system and adjust system flow rate for maximum efficiency of the removal of cuttings from the drilling mud.

It is thus an object of the invention to provide an improved, portable, self-contained mud processing system with first and second stage centrifuges. The first stage is operated so that the heavy weight materials of importance are removed. This involves recovering the components of the weight material which have a specific gravity of about 4.0. By judicious adjustment control of the throughput a desirable weight separation is accomplished. The weight materials are recovered substantially free of low gravity components. By using two separate stages, the heavy weight materials of value are removed and placed back in the drilling mud. Whether the drilling mud solvent is water or expensive oil, the present invention permits it to be recycled several times through the mud system.

Moreover, the present apparatus sets out a control so that adequate pump flow is maintained to feed the first and second stage centrifuges and to maximize undesirable solids removal. The centrifuges are provided with a positive pump fluid flow input. In addition, the centrifuges are provided with that input subject to safe control so that the centrifuges are not overloaded. This enables the centrifuges to operate such that each removes a specified or desired specific gravity of solids. The first stage centrifuge removes high gravity solids and the second stage centrifuge removes low gravity solids. The solids are discharged from each centrifuge with a small amount of solvent so that they form a slurry.

The system incorporates a controller which monitors the operation of the pumps and centrifuges to achieve optimum separation. It is thus an object of the present invention to provide a system of sensors and a controller to maximize the removal of undesirable low gravity solids while retaining high gravity additives in the drilling mud.

The system further incorporates a system of mass flow sensors to monitor operation of the system, and to demonstrate an objective measure of the undesirable solids removed by the dual-stage separation system. The central processor receives inputs from the sensors and manually entered data of quantitative analysis of the makeup of the drilling mud at various points in the system. This data is then assembled to provide a readout and a report to demonstrate to a system operator savings realized by use of the system. The data is also assembled to show the quantity of solids and contaminants discharged from the system in order to meet governmental regulations.

The present apparatus is summarized as a skid mounted unit incorporating first and second stage centrifuges. The input is through a mud line connected from the mud pit or other point in the mud system. Storage tanks are also included. The input connects through a first positive displacement pump, then a high gravity solids centrifuge, and then through a second positive displacement pump and then a low gravity solids centrifuge. Following the low gravity solids centrifuge, the solids discharged may then be disposed of or they may be directed to a cuttings drier to further separate drilling mud solvent and low gravity solids.

The system also utilizes appropriate sensors which monitor the state or condition of the two pumps and centrifuges and other system components. Signals are provided to a controller system which monitors operation to avoid system overload and to control system operation for maximum solids removal.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF PREFERRED EMBODIMENTS

Figure 1:
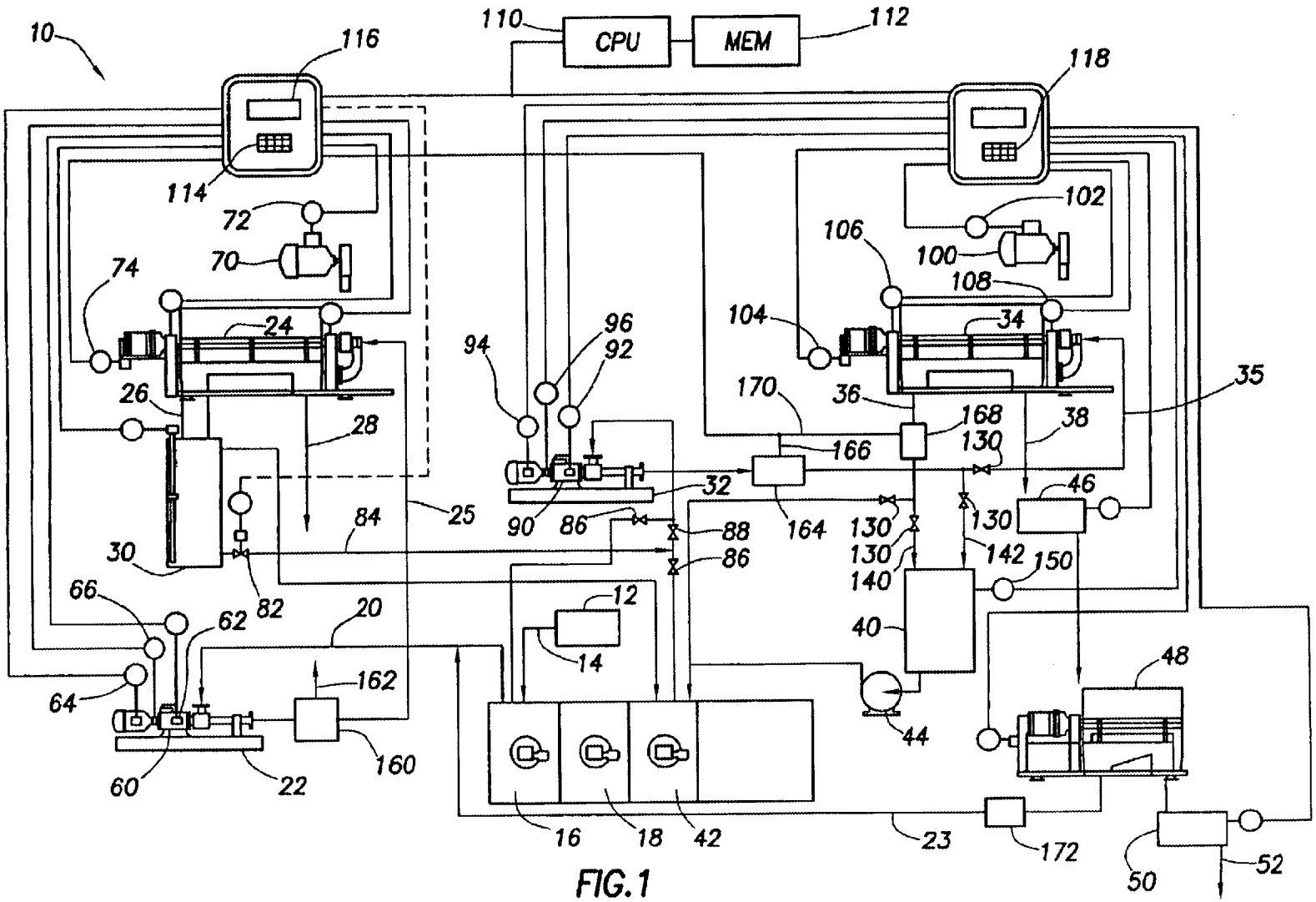
FIG. 1 is an overall schematic diagram showing the apparatus of this disclosure including appropriate pumps and centrifuges subjected to control by a set of sensors cooperative with an operator input keypad and CPU system.

FIG. 1 depicts a mud clarification or processing system 10 of the present invention. The system is temporarily assembled adjacent to a drilling rig (not shown) and typically includes a set of mud pits which receive the used mud from the well borehole. The mud delivered to the mud pits is transferred to a shale shaker and then a degasser, shown schematically in FIG. 1 with the reference number 12. The degasser reduces the amount of gas in the mud and the shale shaker picks up large particles which are collected on a screen in the shale shaker for removal from the mud. From the shale shaker, a mud line 14 is connected into the system 10. The principle components of the system will now be described.

Supply of drilling mud enters the system from the mud line 14 into a first storage tank 16. There is a second storage tank 18 which can be optionally connected. Drilling mud from the first storage tank 16 is directed through a supply line 20 into a first positive displacement pump 22. Note also that a recirculation line 23 is coupled into the supply line 20, to be described below.

Mud is pumped by the pump 22 into the inlet of a first stage centrifuge 24 by way of a supply line 25. As previously described, the first stage centrifuge is controlled to separate the desirable, heavy components which have been added to the drilling mud, while passing the lighter weight cuttings. As viewed in FIG. 1, a liquid discharge 26 from the centrifuge 24 is on the left, and a solids discharge 28 is on the right. The liquid discharge 26 is directed into a surge tank 30, which maintains net positive suction head to a second stage positive displacement pump 32. Fluid is discharge by the second stage pump 32 into a second stage centrifuge 34 by way of a supply line 35. Like the centrifuge 24, the second stage centrifuge 34 has a liquids discharge 36 on the left and a solids discharge 38 on the right as seen in FIG. 1. From this point on, the liquid from the liquids discharge may be referred to as centrate.

Up to this point in the description, the system of FIG. 1 is like that of a parent application Ser. No. 09/060,046. The system 10 further includes a number of refinements and innovations. For example, the liquids discharge 36 from the centrifuge 34 may be directed to a mass flow sensor 40 to determine the solids in a liquid sample, described below with regard to FIG. 3. However, during normal steady state operation of the system 10, centrate is directed to a storage tank 42 directly. Following measurement in the sensor 40, the liquid in the sensor 40 is pumped by a centrifugal pump 44 into the tank 42.

The solids discharge 38 from the second stage centrifuge 34 is also directed to a mass flow sensor 46. The mass flow sensor 46 may preferably be a modified mass flow sensor like those available from Ramsey—A Thermo Sentron Company, 501 90th Avenue N.W., Minneapolis, Minn. 55433. From the mass flow sensor 46, the discharge solids are directed to a cuttings drier 48, which also receives a flow of solids from the coarse mud filtration of shakers, desanders, desilters, and the like, which provided the mud flow input on line 14. The drier 48 is preferably a centrifuge, designed to handle low flow, but high solids loading for further separation of solids from drilling mud. Liquid discharge from the drier 48 is recirculated into the line 20 by way of the recirculation line 23 to recover the drilling mud, and the solids discharge is directed to yet another mass flow sensor 50, like mass flow sensor 46, and then to an outlet 52 for discharge. A fluid flow sensor 172 is provided for a measurement of solvent recovered by the cuttings drier 48. Such an arrangement provides additional savings in two ways. First, the addition of the solids drier 48 recovers more of the drilling mud for further reuse. Second, the more liquid that can be removed from the solids to be discharged, the less volume and weight for disposal.

In addition to the major components just described, the system 10 also includes a number of sensor and control components. The pump 22 is powered by an electric motor 60, which includes an automatic speed control 62 and a current transducer 64 to monitor motor load. The motor also includes a flow sensor 66 which operates off the motor because it drives a positive displacement pump, and motor speed corresponds directly to fluid flow through the pump.

The centrifuge 24 is also provided with a number of sensors and controls. The centrifuge is driven by a main drive motor 70 which includes a current transducer 72. The centrifuge 24 includes a torque switch 74 to trip the centrifuge if it becomes clogged or overloaded. Finally, the centrifuge is provided with temperature sensors 76 and 78 to monitor bearing temperatures as a safety measure.

As previously described, the centrifuge 24 discharges liquid into a surge tank 30. The surge tank includes a level sensor 80 to monitor surge tank level, and discharge from the surge tank 30 into the suction of the pump 32 is controlled by a motor operated valve 82 in a discharge line 84. Note also that the second stage pump 32 may be lined up to take a suction from the tank 42 by a set of valves 86 and 88. This feature is useful during early stage, shallow drilling when large volumes of drilling mud must be processed so the pumps 22 and 32 may be lined up in parallel.

Just like the pump 22, the pump 32 is powered by an electric motor 90, which includes an automatic speed control 92, a current transducer 94 to monitor motor load, and a flow sensor 96. And, just like the centrifuge 24, the centrifuge 34 is driven by a main drive motor 100 which includes a current transducer 102, a torque switch 104, and temperature sensors 76 and 78.

The numeral 110 identifies a CPU equipped with an attached memory 112. In the preferred embodiment, the system is equipped with a key pad 114 and companion display 116. Optionally, a second key pad 118 can be located at another point on the equipment, such as for example close to the second pump, or it can be operated at a convenient location anywhere in the system.

System Operation

As in the parent application, the system 10 effectively removes heavier, valuable additives from the drilling mud in the first stage centrifuge 24 and cuttings and other undesirable solids from the drilling mud in the second stage centrifuge 34. Solids from each of the centrifuges 24 and 34 are discharged in the form of a wet slurry. The bulk of the water or other solvent is discharged through the respective liquids discharges. The dry, high gravity additive ingredients are captured and recycled to be used again. Undesirable, low gravity solids are further dried in the cuttings drier 48 and are then sent out of the system for disposal.

However, the present invention includes a means for determining the effectiveness or efficiency of how well the system is separating solids from the drilling mud, and controlling the system to maintain that efficiency. Generally, the dry ingredients having a specific gravity of about 4.0 are segregated from the other components picked up in the mud stream. Sand and other earth formation ingredients typically have a specific density of about 2.7 or so. The specific density of the heavier additives defines an operating point for the first stage centrifuge 24, which is operated so that the dry ingredients removed from the mud in this stage are the heaviest ingredients. The weight materials delivered from the system at the outlet solids discharge 28 are transferred to any one of the storage tanks, but preferably tank 42. The line 28 leading to the tank 42 is omitted from FIG. 1 for clarity.

The second stage centrifuge removes lighter materials, such as cuttings, from the drilling fluid. Measuring the weight of lighter materials which have been removed from the drilling mud provides a measure of how well the system is recycling drilling mud.

The effectiveness of a centrifuge in removing solids is dependent in part on the dwell time of the fluid in the pond of the centrifuge. This is due in part to Stokes's Law, which provides that a particle in the fluid must travel a certain distance in the fluid away from the axis of the centrifuge toward the bowl in order to be separated by the scrolling action of the conveyor in the centrifuge. If the system is set with too high a feed rate, some of the particles, particularly small diameter and light weight materials, simply have insufficient time to travel radially outwardly toward the bowl of the centrifuge for separation and will pass out of the centrifuge with the liquids discharge.

Figure 2:
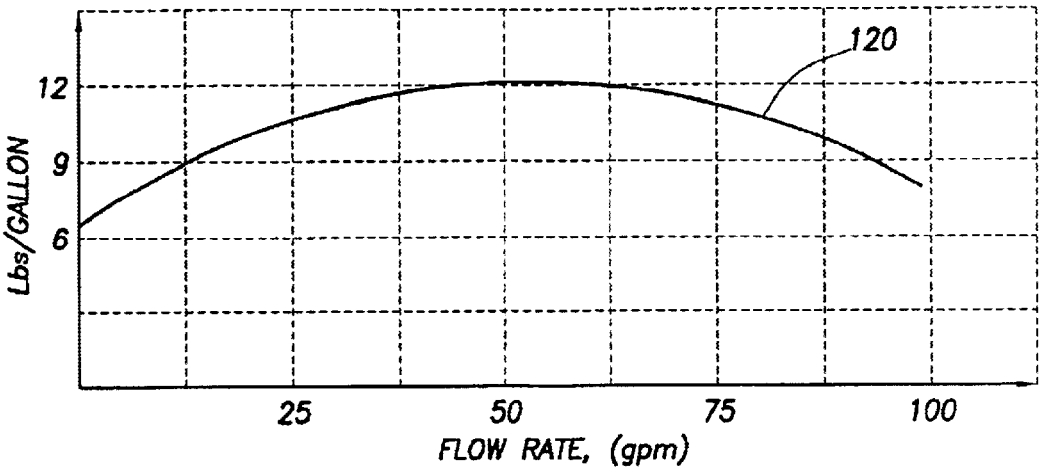
FIG. 2 is a graph illustrating system performance versus flow rate of drilling mud through the system.

This is illustrated in FIG. 2, in which a representative operational curve 120 is shown. A different operational curve will result from the two centrifuges, and the operational curve of a single centrifuge will vary depending on the constituents of the drilling mud and solids carried by it. In the operational curve of FIG. 2, the system operates most efficiently with a feed rate of approximately 50 gpm, at which point roughly 12 pounds per gallon of solids from the drilling mud is being removed. Operating the centrifuge at a higher feed rate results in a drop in the effectiveness of the centrifuge in removing solids.

This concept is not intuitively obvious to operators who are using such a clarification system 10. The natural reaction of operators is to operate the system at maximum flow rate. Thus, it would be helpful to be able to show an objective measure of how much of the solids are being removed. This feature is provided by the present invention as will now be described.

The mass flow sensor 40 is provided with a set of alignment valves 130 which are used to line up the mass flow sensor to receive fluid from either the discharge of the second stage pump (i.e. fluid which is laden with lighter weight, undesirable solids) or the fluids discharge from the second stage centrifuge 34 after the undesirable solids have been removed from the mud. As previously mentioned, the valves 130 are normally aligned so that the liquids discharge from the second stage centrifuge flows into the storage tank 42. To determine what weight of solids which are being removed by the system, a first sample is taken into the mass flow sensor 40 of the pump 32 discharge and the weight of the sample is measured. This sample is then pumped out of the sensor 40 into the storage tank 42 by the pump 44. Then, a second sample is taken, this time of the liquids discharge 36 of the second stage centrifuge. The weight of the second sample is measured, and compared to that of the first sample. Not only is this a measure of the effectiveness of the system in removing solids from the drilling mud, it is a direct measure of how much money the system of the present invention saves the user, since every gallon of drilling mud that is purified translates directly into monetary savings in drilling mud which does not have to be replaced into the system. This sample is also preferably analyzed to determine the mix of high and low gravity solids, as well as fluid constituents, in the sample fluid. This analysis is input into the CPU 110 to generate a report of the drilling mud makeup, and for adjustment of the first stage centrifuge bowl speed for maximum recovery of high gravity additives such as barite.

For example, the drilling mud typically will satisfy operational requirements if it has a low gravity solids loading of less than or equal to about 5%. Other target solids loading may apply in various circumstances. Thus, if one barrel of low gravity solids is removed from the system 10, then 19 barrels of drilling mud have been saved. This is because that 19 barrels of drilling mud do not have to be added into the system to dilute the mud down to a maximum of 5% low gravity solids.

Figure 3:
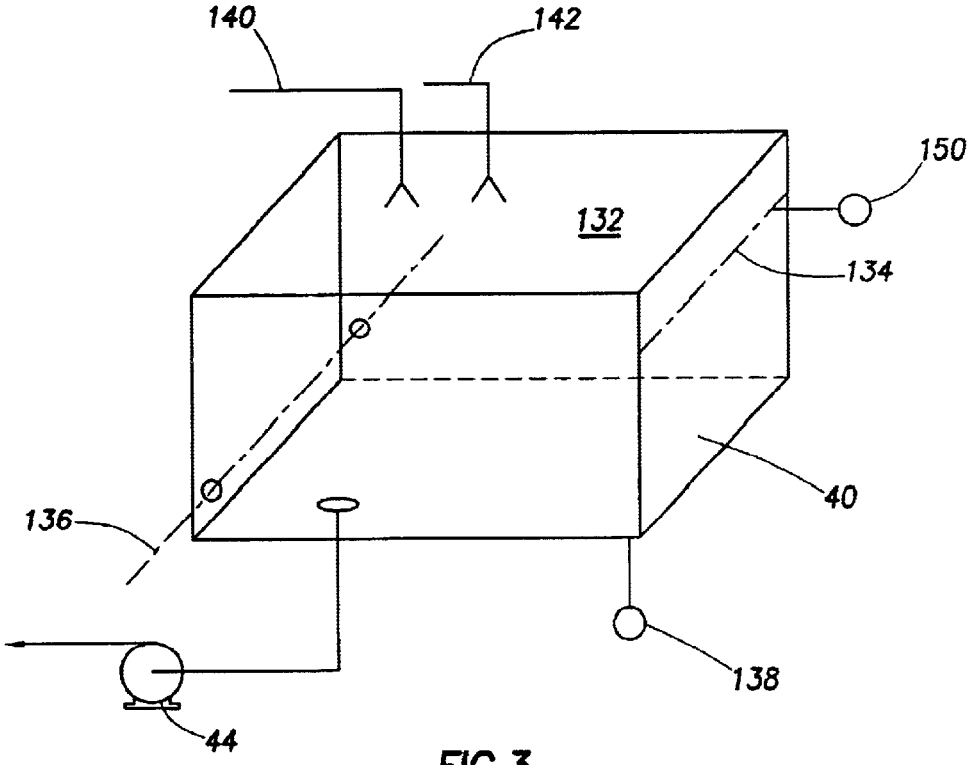
FIG. 3 is a schematic diagram of a preferred mass flow sensor for batch processing of system fluid for a determination of undesirable solids removed by the system.

FIG. 3 depicts one way of carrying out that method. The mass flow sensor 40 includes a tank 132 which includes a level indicator 134. A sight glass may alternatively be provided or a level sensor 150 may be provided. In either case, level indication provides a measure of system fluid flow rate. The tank 132 is mounted for axial rotation on an axis 136 and a weight sensor 138 is provided opposite the axle 136 to measure the weight of the tank when it has been filled to a predetermined level with fluid, for example with 100 gallons of fluid. Fluid is introduced to the tank 132 for the first sample through a sample line 142 (see also FIG. 1). After the first sample is weighed, the tank is pumped out by the pump 44, and a sample line 140 is aligned to provide a sample. This sample is then weighed and compared to the first, solids laden sample. The flow rate of the second stage centrifuge may then be adjusted, and comparison made to determine the effect of the adjustment on the effectiveness of the system in removing solids. Flow rate is then adjusted for maximum removal of solids, as shown in FIG. 2, and then conveyor speed of the second stage centrifuge is adjusted to result in the driest solids discharge from this centrifuge.

The tank 42 serves as a repository for clarified drilling fluid. The solvent is delivered back to this tank and the "dry" additive ingredients are added to it so that the weighted drilling fluid can be restored and then recycled in the mud system. A suitable vacuum line connected with the tank 20 can be used for this purpose.

Another important aspect of the present invention is the apparatus which responds to dynamics in operation to avoid overload. Briefly, each centrifuge is susceptible to overload by overfeeding the centrifuge. They are designed to convey a specific amount or weight of solids. While this might represent a specific liquid volume, the liquid volume is not the only factor to define the weight of the material which is conveyed by it. If a fixed volume is increased in weight from 12 pounds to 16 pounds per gallon, the weight goes remarkably high and requires greater torque. The equipment includes the several sensors previously described which measure the operative status of the centrifuges and the pumps which feed them for purposes of control.

Assume as an example that the flow delivered to the system has a specified weight. Assume also that the dwell time of the flow in the system is such that the weight actually conveyed in the first centrifuge represents 80% of maximum permitted. Should the weight of the spent drilling fluid go up, say from 16 to 18 pounds, then the increase in weight (of $2/16$ or 12%) in the first centrifuge may cause an overload. The overload is normally sensed and results in shutdown of the equipment. In turn, this will interrupt the drilling process. To avoid that problem, the operating conditions of the first centrifuge are noted continuously and monitored by the CPU 110. As the load on the first centrifuge is increased, a signal is formed and transmitted to the CPU 110. This signal is then used to make a change in operation such as for example by reducing the throughput of the pump 22. This can be done by simply reducing the speed of the pump motor 60. When the this occurs, the amount of weight conveyed in the centrifuge is reduced. As the throughput is decreased, the torque required for safe operation is also reduced.

It will also be appreciated by those skilled in the art that volumetric flow is provided by the sensors on the first and second stage pumps 22 and 32, and that sample points are commonly provided at various points throughout a mud clarification system. Thus, samples may be taken at the sample points in the system and the samples analyzed for high and low gravity solids, as well as fluid constituents. The analysis results may then be input into the CPU 110 for adjustment of the speed of the pumps 22 and 32 and the bowl speeds and conveyor speed of the first and second centrifuges.

Real Time Operating Point Control

In addition to or in the alternative to the batch measurement of solids removed by the system, the system 10 may include in line sensors to determine the solids loading of the mud at various points in the system. A sensor 160 is provided at the discharge of the first stage pump 22 to measure solids content of the unprocessed mud. The sensor 160 preferably measures the specific gravity of the fluid, and this measurement is sent to the CPU 110 over a sensor line 162. At this stage, the specific gravity of the mud solvent is known, and the measurement of the sensor 160 provides a measure of the total solids loading in the mud.

A sensor 164 is provided at the discharge of the second stage pump 32. The sensor 164 also measures the specific gravity of the fluid, and this measurement is sent to the CPU 110 over a sensor line 166. The specific gravity measurement at this point is that of the mud plus the loading of the low gravity solids. Next, the liquid discharge of the second stage centrifuge 34 may be provided with a sensor 168. The sensor 168 measures the specific gravity of the censate, after the undesirable solids have been removed from the mud, and this measurement is sent to the CPU over a sensor line 170.

Now that the system knows the fluid flow rate (from the sensors 66 and 96), and the weight of solids being removed by the second stage centrifuge (the difference between the measurements taken by the sensors 164 and 168 respectively), a point on the operational curve 120 can be calculated by the CPU 110. Then, the speed of the second stage pump 32 can be incrementally adjusted to a higher speed, and a second set of measurements made. A comparison is then conducted with the first set of measurements. If greater pounds/gallon is obtained at the higher speed, the speed of the pump 32 is again incrementally adjusted to a higher speed. This process is continued until the effectiveness of removing solids begins to drop, at which point the new operating point of flow rate for the system is set. If after the first incremental speed adjustment the measurement indicates that fewer solids were removed, the speed is incrementally adjusted down until a new peak performance point is determined.

The data also provides an objective measurement of how much the system 10 saves the operator of the system. Fluid flow through the system has now been determined, and the system provides an objective measurement of how much mud is being returned to the system for reuse. If the drilling mud costs $115 per barrel, and over a predetermined time period 10 barrels of low gravity solids are removed, this results in a savings of about $21,850 since the drilling mud need not be diluted by 190 barrels of mud, as previously described. This result is calculated by the CPU and displayed by the displays 114 and 118. Further, a log may be generated and a printed report made.

An additional benefit of the present invention is that the quantities of liquids and solids are known throughout the system as determined by the various sensors. Consequently, the system keeps track of what is discharged from the system 10 for disposal. This includes certain contaminants, such as oil based or synthetic mud solvents, and the discharge of such contaminants is controlled by such governmental agencies as the Environmental Protection Agency. So, the present invention provides the user with an objective measurement of the discharge of these controlled contaminants, and a verified report can therefore be provided of such discharges.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

We claim:

1. A drilling mud reclamation system comprising:

(a) a mud inlet line adapted to be connected to a source of solids-laden drilling mud;

(b) a first stage centrifuge provided with the mud from the source for separating heavy weight solid components from the mud and forming a first stage liquid discharge, wherein the first stage liquid discharge is input into a surge tank and the surge tank connects through an outlet valve to the second stage centrifuge;

(c) a second stage centrifuge provided with the first stage liquid discharge for removing lighter weight solid components in the first stage liquid discharge and for forming a second stage liquid discharge and a second stage solids discharge defining a weight;

(d) a mass flow sensor for measuring weight of the second stage solids discharge; and (e) a flow rate sensor for measuring the flow rate of first stage liquid discharge through the second stage centrifuge.

2. The system of claim 1 including first and second stage pumps connected to respective inputs of said first and second stage centrifuges.

3. The system of claim 2, further comprising a central processor for monitoring and controlling the operation of the first and second stage pumps.

4. The system of claim 3, wherein the central processor controls the operation of the second stage pump at the point in its operational characteristic for maximum removal of lighter weight solid components from the drilling mud.

5. The system of claim 4, further comprising a first mud flow sensor on the first stage pump and a second mud flow sensor on the second stage pump.

6. The system of claim 5, wherein the central processor is adapted to calculate the quantity of low gravity solids removed by the reclamation system based on the mud flow sensed by the second mud flow sensor and the weight of solids removed by the second stage centrifuge as sensed by the mass flow sensor.

7. The system of claim 6, wherein the central processor is further adapted to calculate economic savings from the quantity of drilling mud which been not be added to the system for dilution purposes.

8. The system of claim 6, wherein the central processor is further adapted to modify the operation of the second stage centrifuge based on the mud flow sensed by the second mud flow sensor and the weight of solids removed by the second stage centrifuge as sensed by the mass flow sensor.

9. The system of claim 3, further comprising:

a. means for determining the quantity of high gravity solids removed by the first stage centrifuge; and b. wherein the central processor is adapted to vary the bowl speed of the first stage centrifuge to maximize the high gravity solids content of the first centrifuge solids discharge.

10. The system of claim 1, further comprising a sensor for measuring liquid level in the surge tank.

11. The system of claim 1, wherein the mass flow sensor communicates with the second stage liquid discharge from the second stage centrifuge, and wherein the mass flow sensor comprises:

a. a liquid receiving tank;

b. a liquid level indicator for indicating liquid level in the liquid receiving tank; and c. a weight sensor to measure the weight of the liquid in the tank.

12. The system of claim 11, wherein the mass flow sensor is adapted for a determination of the difference in solids into and out of the second stage centrifuge.

13. The system of claim 11, wherein the liquid receiving tank is mounted for axial rotation on an axis.

14. The system of claim 1, wherein the second stage centrifuge forms a second stage solids discharge and the mass flow sensor communicates with the second stage solids discharge.

15. The system of claim 14, further comprising a cuttings drier to receive the second stage solids discharge and to remove liquid from the second stage solids discharge.

16. The system of claim 15, further comprising:

a. first and second stage pumps connected to respective inputs of said first and second stage centrifuges; and b. a central processor for monitoring and controlling the first and second stage centrifuges, the first and second stage pumps, and the cuttings drier.

17. The system of claim 1, further comprising a central processor for monitoring and controlling the operation of the first and second stage centrifuges.

* * * * *